US005914459A

United States Patent [19]

Teske et al.

[11] Patent Number: 5,914,459

[45] Date of Patent: Jun. 22, 1999

[54] ACCELERATION/DECELERATION SENSING SWITCH FOR MUNITIONS

[75] Inventors: Larry A. Teske, Prior Lake; Kevin J. Olson, White Bear Lake; David P. Erdmann, Hopkins; Michael A. Johson, Chaska, all of Minn.

[73] Assignee: Alliant Techsystems Inc., Hopkins, Minn.

[21] Appl. No.: 08/905,173

[22] Filed: Aug. 1, 1997

[51] Int. Cl.[6] ..... F42C 15/40; F42C 1/00

[52] U.S. Cl. ..... 102/262; 102/272

[58] Field of Search ..... 102/262, 272, 102/273, 266, 216

[56] References Cited

U.S. PATENT DOCUMENTS

| | | | |
|---|---|---|---|
| 3,158,705 | 11/1964 | Bliss | 102/216 |
| 3,453,406 | 7/1969 | Pope | 102/262 |
| 4,174,666 | 11/1979 | Lucey, Jr. et al. | 102/216 |
| 4,284,862 | 8/1981 | Overman et al. | 102/262 |
| 4,674,406 | 6/1987 | Freiling | 102/262 |
| 4,982,664 | 1/1991 | Norton | 102/272 |

FOREIGN PATENT DOCUMENTS

| | | | |
|---|---|---|---|
| 0 466 021 | 1/1992 | European Pat. Off. | H01H 35/14 |

OTHER PUBLICATIONS

Army Research Lab Specification Control Drawing for Part. No. #11718418, entitled "Impact Switch." Aug. 27, 1974.

*Primary Examiner*—Charles T. Jordan
*Assistant Examiner*—Theresa M. Wesson
*Attorney, Agent, or Firm*—George A. Leone; Mark Goldberg

[57] ABSTRACT

A discriminating deceleration sensing electrical switch assembly is enclosed within a munitions projectile for providing an electrical circuit path between a pair of electrical contacts upon deceleration of the projectile being greater than a selected deceleration threshold value. The discriminating deceleration electrical switch assembly includes a switch support having a bore hole for holding a spherical mass or ball. A tactile dome switch or snap switch is juxtaposed between an electrical contact assembly, including a pair of electrically conductive surface regions, and the spherical mass. The components are arranged along the munitions firing axis such that, upon sufficient deceleration along the firing axis, a force acting on the spherical mass will cause the dome switch to deform and contact the conductive surface regions to provide switch closure. Electrical wiring leading from the electrically conductive surface regions are intended to be electrically connected to a detonation control circuit so as to initiate detonation of the munitions. The switch may also be configured as an acceleration switch without the spherical mass and, alternatively as a combination acceleration/deceleration switch.

13 Claims, 4 Drawing Sheets

ACCELERATION/DECELERATION SENSING SWITCH FOR MUNITIONS

FIELD OF THE INVENTION

The present invention relates generally to acceleration and deceleration sensitive electrical switches applicable for munitions.

BACKGROUND OF THE INVENTION

Launched munitions projectiles are generally referred to as "combat rounds." For the purposes of this application they are referred to herein as "projectiles." Designing combat round fuzing systems for munitions systems has become a rather sophisticated design challenge. This is due to several factors that must be considered in contemporary designs, including safety factors, increasing functional density requirements, and restrictions on volume. These and other factors have combined to complicate the design of combat round fuzing.

One of the many functions required of a combat round munitions fuze is the ability to reliably detonate the projectile on impact. As will be appreciated by those skilled in the art, a combat round that does not detonate upon impact remains a hazard to human life and property until it is removed, detonated or disarmed. It will also be appreciated that the proper disposition of undetonated combat rounds is extremely expensive and dangerous. Unfortunately, many of the fuzes currently employed in the art do not reliably detonate the combat round upon impact at slight grazing angles, thus, often creating such hazardous conditions.

In addressing the detonation requirements for detonating a combat round, there are at least two types of impact detonation that must be considered in the design of a combat round fuze. The first type of impact is a "head-on" impact which occurs when the projectile hits a target head-on. A "head-on" impact results in the projectile being subjected to a high deceleration force directed mainly along its longitudinal axis. Designing for a "head-on" impact customarily employs some type of "crush switch" mechanism. As known in the art, a crush switch provides electrical switch closure of a pair of contacts as the nose of the projectile collapses upon impact of the projectile upon the target. The closed pair of contacts, in turn, activate detonation control electronics that initiate the fuze detonation process.

The second type of impact considered is a "non-head-on" impact which occurs when the round does not hit head-on, but rather, grazes a target. For a "non-head-on" impact, a crush switch may not reliably provide the switch contact closure function needed to detonate the fuze. This is particularly a problem if the target impact graze angle is too slight to activate the crush switch. At such a slight target impact angle, a diminished or incomplete crushing of the combat round nose may result in a lack of detonation.

One example of a crush switch often used in combat round munitions applications is an impact switch commonly known as a Lucey Switch, in honor of its inventor. One such impact switch is specified in Army Research Lab Specification Control Drawing for Part. No. #11718418, entitled "IMPACT SWITCH." In the specified impact switch, a spring is employed for exerting a selected spring force substantially against a conically shaped electrical contact. Upon impact of the projectile against a target, the spring collapses, thereby allowing the conically shaped electrical contact to electrically connect with a receiving electrical contact to initiate activation of a fuze resulting in detonation of the projectile.

Other factors must also be considered in fuze designs, for example, in many combat round munitions applications, as well as other munitions applications, firing of the projectile must be detected before detonation of the fuze. Firing of the projectile is referred to as the "firing event." In essence, detection of the firing event enables firing event detection electronics to initiate time dependent functions. An apparatus including firing event detection electronics is sometimes referred to as a setback detector.

A firing event setback detector is generally constructed so as to only detect the occurrence of an acceleration along the firing axis. Generally, the firing axis coincides with the longitudinal axis of the projectile since the velocity component along the firing axis increases rapidly from zero velocity before the firing event to a very high velocity after the firing event. In an ideal setback detection mechanism, the setback detector would provide a setback detection signal when the setback force along the firing axis increases above a selected acceleration threshold so as to provide a safety margin against premature detonation of the combat round. At the other extreme, an ideal impact detection mechanism would provide an impact detection signal under any deceleration condition along the firing axis above a selected deceleration threshold, so as to also provide a safety margin to assure detonation upon impact.

SUMMARY OF THE INVENTION

In accordance with one embodiment of the present invention, a discriminating deceleration electrical switch assembly is enclosed within a munitions projectile for closing an electrical circuit path between a pair of electrical contacts upon deceleration of the projectile exceeding a selected deceleration threshold value. The discriminating deceleration electrical switch assembly comprises a switch support having a bore hole therein for holding a spherical mass or ball. A tactile dome switch or snap switch is juxtaposed between an electrical contact assembly and the spherical mass. The electrical contact assembly has a pair of electrically conductive surface regions. The aforesaid components are arranged along the munitions firing axis such that, upon sufficient deceleration along the firing axis, a deceleration force acting on the spherical mass will cause the dome switch to deform and make contact with the conductive surface regions thereby providing switch closure. Electrical paths leading from the electrically conductive surface regions are intended to be electrically connected to a detonation control circuit so as to initiate detonation of the munitions upon switch closure.

In an alternate arrangement, the snap switch and electrical contact assembly are arranged so as to provide an acceleration switch or setback detection mechanism such that switch closure is made upon the acceleration of the munitions exceeding a selected acceleration threshold.

In yet another arrangement, a pair of dome switches are employed in combination with a pair of electrical contact assemblies and a single spherical mass so as to provide a combined acceleration/deceleration munitions switch assembly.

In yet another arrangement, a pair of dome switches are employed in combination with a pair of electrical contact assemblies so as to provide a combined acceleration/deceleration munitions switch assembly wherein the dome switches close upon being subjected to a selected threshold level of acceleration or deceleration force, as the case may be.

Other objects and features and advantages of the present invention will become apparent to those skilled in the art through the description of the preferred embodiment, claims and drawings herein wherein like numerals refer to like elements.

DETAILED DESCRIPTION OF THE INVENTION

Figure 1:
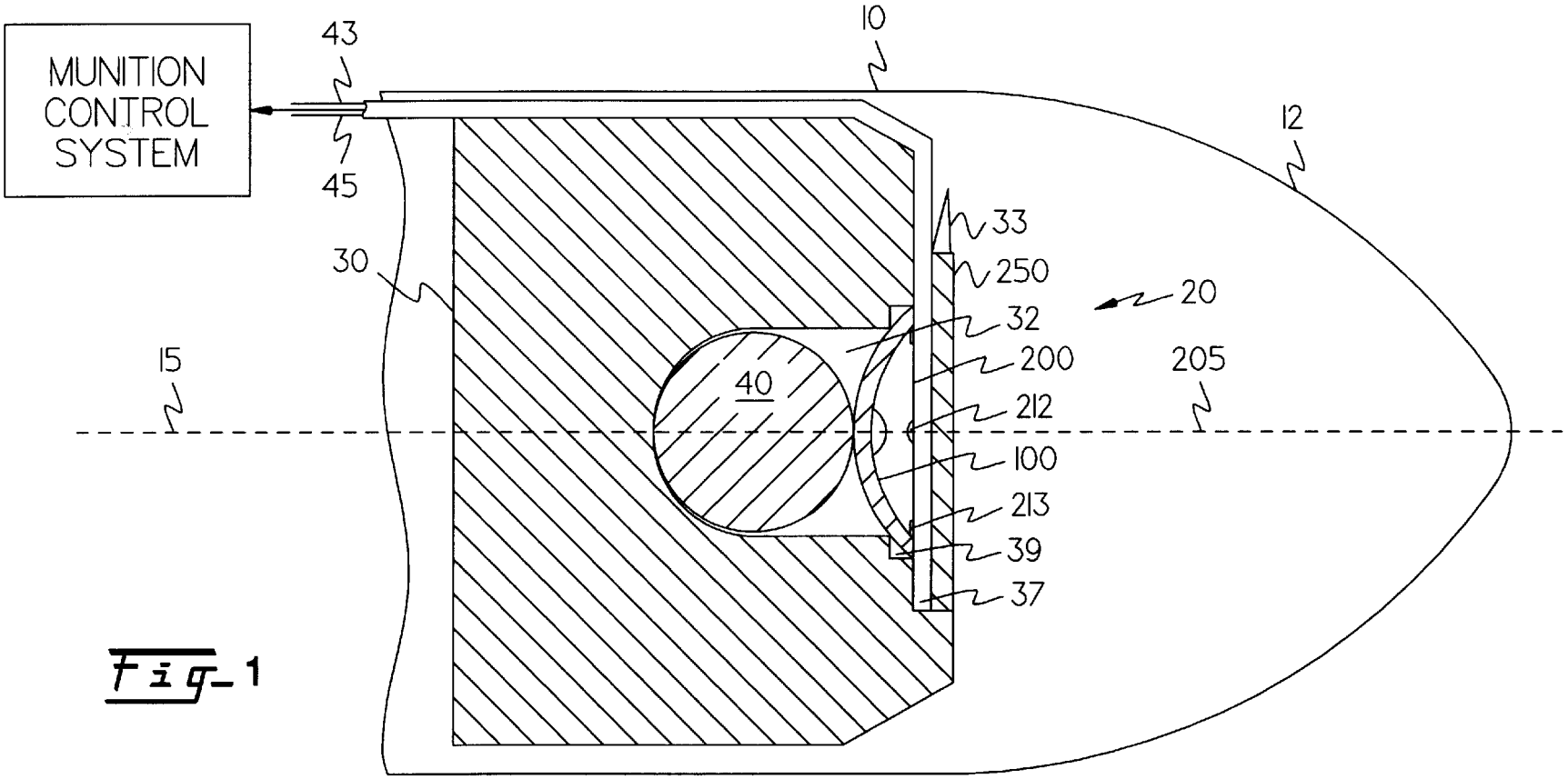
FIG. 1 is a partial cross sectional view of a projectile employing a deceleration switch in accordance with the present invention.

Illustrated in FIG. 1 is a partial cross sectional view of a projectile 10 employing a discriminating deceleration switch constructed in accordance with the principles of the invention. The discriminating deceleration switch is generally indicated by numeral designation 20 and is particularly applicable for munitions systems where the projectile is intended to be detonated upon impact with a target.

For exposition purposes, a projectile reference or firing axis 15 is shown. The firing axis 15 is generally aligned with the intended traveling or firing direction of the projectile, commonly the longitudinal axis of the projectile. In one embodiment the firing axis 15 may advantageously extend centrally from nose 12 to tail (not shown). Discriminating deceleration sensing switch 20 is disposed to sense directional motion along the firing axis axis in a manner described below.

Discriminating deceleration sensing switch 20 includes switch housing or switch support means 30 rigidly secured to projectile 10 by mechanical means not shown, but which may include, among others, threadable engagement, cement, or other techniques for securing switch support means 30 to projectile 10. Switch support means 30 may also be made as an integral part of the projectile. Switch support means 30 includes a central chamber or bore hole 32 having an open end extending from a surface 33 of switch support means 30. In one embodiment of the invention, bore hole 32 is generally a circular hole having a selected bore hole diameter with a central bore hole reference axis passing axially therethrough. The central bore hole reference axis is advantageously aligned with the firing axis 15.

The switch support means 30 also has counter sunk bore holes 37 and 39 concentric with bore hole 32. Counter sunk bore holes 37 and 39 have larger diameters than the diameter of bore hole 32. Counter sunk bore hole 37 has a larger diameter than counter sunk bore hole 39. Counter sunk bore hole 37 is sized to receive an electrical contact assembly 200, and counter sunk bore hole 39 is sized and shaped to receive and hold a tactile dome switch member 100.

Figure 2:
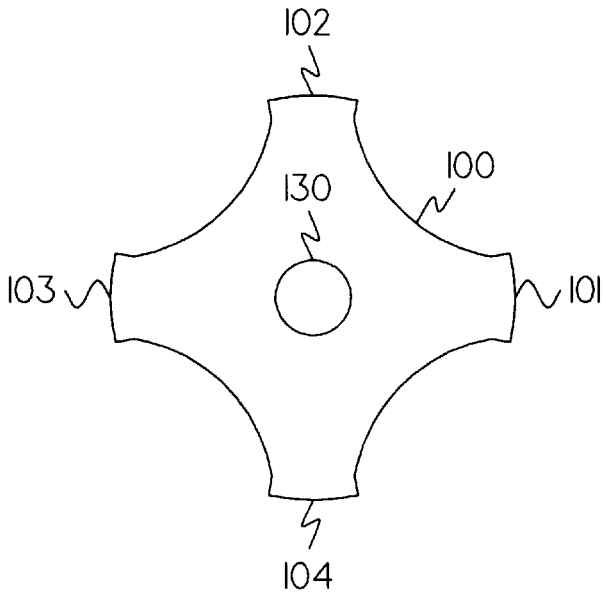
FIG. 2 is plan view of one embodiment of a dome switch depicted in FIG. 1.
Figure 3:
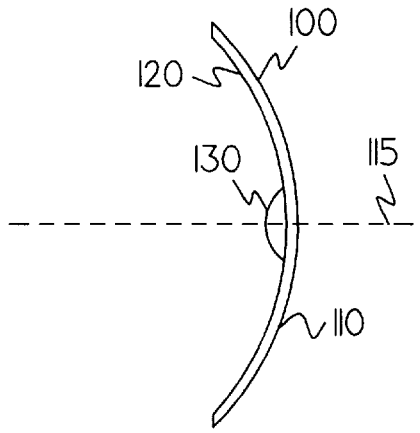
FIG. 3 is side view of the dome switch depicted in FIG. 2.

Referring now to FIGS. 2 and 3, further details of tactile dome switch member 100 are illustrated therein. Tactile dome switch member 100 is effectively an electrically conductive disk like member having a convex surface 110 and a concave surface 120, opposite convex surface 110. Dome switch member 100 has a central disk reference axis 115 passing centrally through the concave and convex surfaces. In the example shown, dome switch member 100 further includes an optional central dimple 130 extending away from the concave surface 120. It will be understood that the central dimple 130 is not required for operation, although it is desirable in some embodiments of the invention. Dome switch member 100 may advantageously comprise a scalloped disc that further includes a plurality of contact terminals 101, 102, 103 and 104. An example of dome switch member 100 as depicted in FIGS. 2 and 3 may be provided by Snaptron Inc., Loveland Colo., identified as F series Tactile Domes. Such domes are constructed of a electrically conductive material and may incorporate anti-oxidizing coatings such as nickel, silver, gold, or the like.

Referring again to FIG. 1, an electrical contact assembly 200 is shown affixed to the switch support means 30 within counter bore hole 37 by means, not shown, such as cementing or other means. By way of illustration, electrical contact assembly 200 may be mounted to a support member or substrate 250 which may also serve, in part, as an end cap for enclosing the assembly of dome switch member 100 juxtaposed between mass 40 and electrical contact assembly 200. In one useful embodiment, mass 40 may be a spherical mass such as a ball bearing or the like. However, the mass need not be spherical. Any appropriate mass may be used so long as it is of sufficient size and shape to snap over the dome switch at the selected threshold force. For some applications the use of a mass is not even necessary because the dome switch, if suitably selected, will snap over when subjected to the acceleration or deceleration force at the selected threshold.

Figure 4:
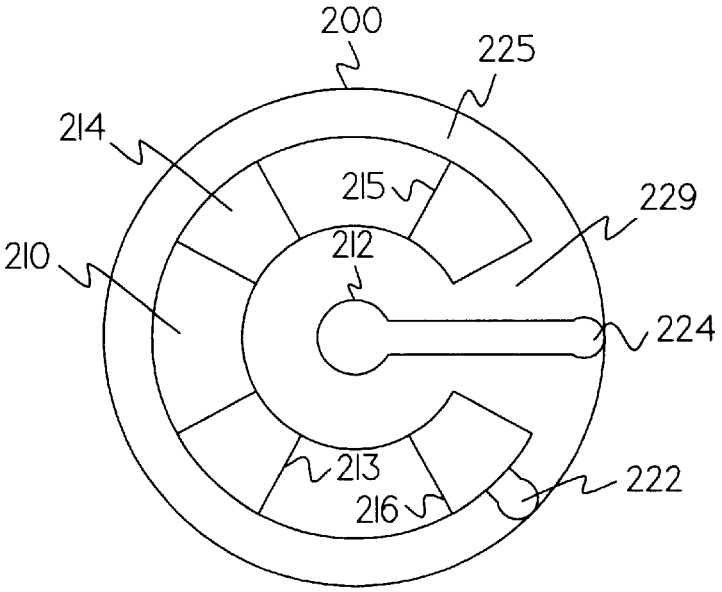
FIG. 4 is a plan view of one embodiment of an electrical surface contact assembly as depicted in FIG. 1.

Referring now to FIG. 4, the electrical contact assembly 200 is illustrated in more detail. The electrical contact assembly 200 may advantageously be an electrical conductor arrangement including a centrally located first electrically conductive surface region 212. The first electrically conductive surface region 212 has a contact reference axis 205 passing perpendicularly through the center (as best shown in FIG. 1). Electrically isolated from electrically conductive surface region 212 is a plurality of electrically conductive surface regions 213, 214, 215, and 216. The plurality of electrically conductive surface regions 213, 214, 215, and 216 are electrically connected in common by an electrical conductor 210. Those skilled in the art will appreciate that the electrical contact assembly 200 as shown in FIG. 4 may advantageously be a printed circuit substrate or a flexible electrical printed circuit tape.

Figure 6:
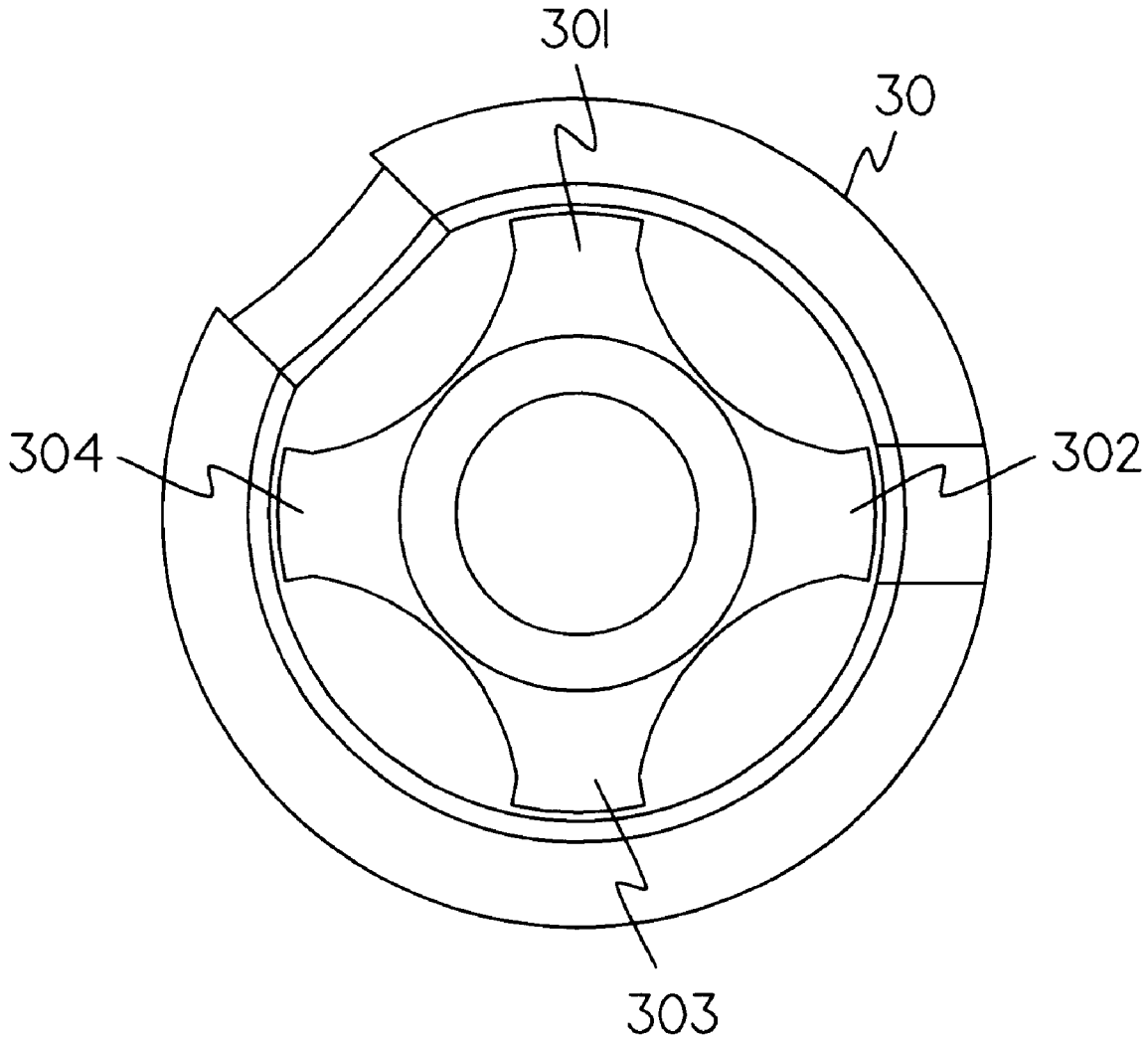
FIG. 6 is a plan view of one embodiment of a switch housing as depicted in FIG. 1.

Referring now to FIG. 6, one example of switch housing 30 is shown. The switch housing 30 includes a plurality of recesses 301, 302, 303 and 304 that are suitably sized and shaped to loosely receive terminals 101–104 respectively so as not to restrict the axial movement of the dome switch. When assembled, dome switch member is seated within the plurality of recesses so as to prevent rotation of dome member 30 within the projectile, thereby assuring alignment of the dome switch terminals 101–104 with the plurality of electrically conductive surface regions 213, 214, 215, and 216.

As illustrated in FIG. 4, electrical contact assembly 200 may be a flexible circuit board or equivalent apparatus. The electrical conductor 212 may be advantageously configured so as to include an isolated region 229 around a soldering pad 224 that is integral to electrical conductor 212. A non-conductive coating may be deposited over electrical conductor 210 in a manner so as to leave electrically conductive surface regions 212, 213, 214, 215, and 216 exposed. Electrically conductive pads 222 and 224 may also be provided for electrically connecting electrically conductive paths 43 and 45 to electrically conductive surface region 212 and electrically conductive surface region 216, respectively.

The exemplary arrangement of electrical contact assembly 200 depicted in FIG. 4 may also be provided by a wide array of equivalent schemes and techniques well known in the art. Examples of such schemes may be the employment of standard printed wiring boards, flexible wiring harnesses, hybrid circuit substrates, and the like, all of which are intended to be with in the scope and spirit of the present invention, the details of which are well known to the artisan. It should be noted that the exposed electrically conductive surface regions of the electrical surface contact assembly 200 may incorporate particular anti-oxidizing coatings, for example plate tin-lead fuzed, palladium, platinum, gold, and the like.

The structural configuration of the components of the discriminating deceleration switch 20 in accordance with the present invention will now be described. It will be understood that the following description is solely for illustrative purposes and the invention is not so limited. Since bore hole 32 and counter sunk bore holes 37 and 39 are concentric, the projectile reference axis or firing axis 15 will be aligned with the central bore hole reference axis, central disk reference axis 115, and the contact reference axis 205. The depth of bore hole 32, and counter-bore holes 37 and 39 are such that, at rest, mass 40 may rest within bore hole 32, with dome switch member 100 resting in counter-bore hole 39, and the central portion of convex surface 110 of dome switch member 100 in close proximity to the extremity of mass 40. Furthermore, with electrical contact assembly 200 secured within bore hole 37, the concave extremities forming the plurality of terminal legs of the dome switch member 100 contact the plurality of electrical contact regions 213–216 of electrical contact assembly 200 with dimple 130, if present, being aligned with electrically conductive surface region 212.

The arrangement as described above operates such that, if a force acts on mass 40 from left to right, as illustrated in FIG. 1, tactile dome switch member 100 is depressed so as to make electrical contact with electrically conductive surface region 212. The plurality of contact terminals 101–104 are each positioned to be in electrical contact with one of the electrically conductive surface regions 213–216. Accordingly an electrically conductive path is provided between electrically conductive paths 43 and 45 by the switch closure between the electrically conductive surface regions.

Although not illustrated in the Figures, electrically conductive paths 43 and 45 are intended to be electrically coupled to a munitions detonation control system that is responsive to a detection of the switch closure as aforesaid. In this manner, detection of the switch closure will produce detonation of the projectile 10.

In one exemplary embodiment of the invention, the dome switch member 100 has a diameter in the range of 5 mm to 20 mm. The size of mass 40 is, of course, dependent upon the trip or deformation force of the tactile dome switch. Useful trip forces are generally in the order of several hundred newtons.

In one exemplary embodiment, deceleration switch closure was made when the deceleration exceeded a threshold of about 300 g's for a ball mass of about 0.5 grams and a deformation force of about 150 grams for the tactile dome switch. For the same dome switch, acceleration switch closure (setback detection) was made when the acceleration exceeded a threshold of about 19,000 g's. There are, of course, a wide variation of dome switch deformation forces, and ball diameters that will perform in a manner as intended, all of which are within the true spirit and scope of the present invention.

Figure 5:
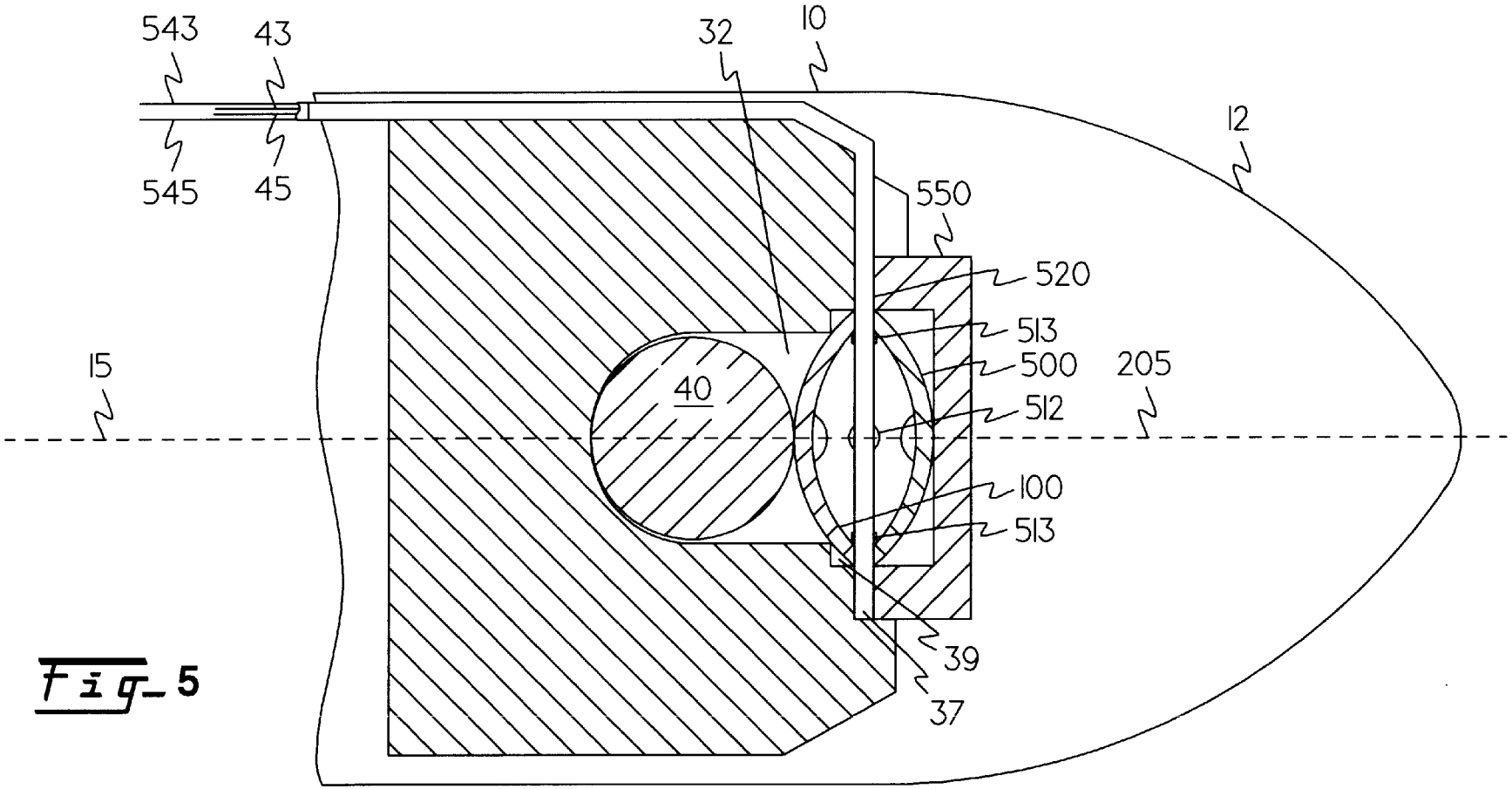
FIG. 5 is a partial cross sectional view of a projectile employing another embodiment of the invention illustrating a combination acceleration and deceleration munitions switch.

FIG. 5 illustrates an alternate embodiment of the present invention that functions as a setback detection mechanism employing a tactile dome switch member 500, similar to tactile dome switch member 100. In FIG. 5 like components as those in FIG. 1 have the same reference numeral. A double sided electrical contact assembly 520 is substituted for the electrical contact assembly 200 of FIG. 1. The double sided electrical contact assembly 520 provides substantially similar and separate electrical conductor arrangements as the one already described with reference to the electrical contact assembly 200 illustrated in FIG. 4.

An end cap 550 is secured to switch housing 30. The end cap 550 includes an outer diameter that, in some examples, may have about the same size as the diameter of bore hole 37. Of course, the end cap diameter is not so limited and may be designed using alternative sizes and shapes to accommodate the end cap function. The end cap 550 also has an inner bore hole with the same diameter as counter bore hole 39. The end cap 550 is shaped for holding in place tactile dome switch member 500 in similar alignment as tactile dome switch 100. However, in contrast to the arrangement of FIG. 1, dome switch member 500 is in mirror arrangement relative to dome switch member 100. Additional electrically conductive paths 543 and 545 are provided so as to provide electrical connection to electrical surface regions 512 and 513, respectively, similar to electrically conductive paths 43 and 45 that are electrically connected to electrically conductive surface regions 212 and 213, respectively.

The arrangement and combination of dome switch member 500 and double sided electrical contact assembly 520 operates to provide a setback detector for munitions projectile 10. In operation, upon an acceleration of projectile 10 of sufficient magnitude to the right and along projectile reference axis 15, tactile dome switch member 500 will deform to make electrical contact with electrically conductive surface region 512. As is the case described above with reference to FIG. 1, the scalloped terminals of dome switch member 500 are positioned to be in electrical contact with one or more of electrically conductive surface regions generally indicated by numeral 513. Thus, switch closure occurs as soon as the switch member 500 comes into electrical contact with the electrically conductive surface region 512 and a short circuit is provided between electrically conductive paths 543 and 545.

It should be noted that the munitions setback mechanism, namely the acceleration sensing switch as just described, may be employed independently of the deceleration sensing switch mechanism. That is, only dome switch member 500 and a single sided electrical conductor arrangement of electrically conductive surface region 512 and regions 513 are required to be mounted to a support means 30 and coupled to the munitions projectile 10. The embodiment described in FIG. 5 is compact and alternate arrangements may be used in other applications where compactness of design is not required. Such examples may include, for example, a design employing separate electrical contact assemblies associated with each dome switch. Further, it will be appreciated that, for some alternate applications, dome switch member 500 may also double as a crush switch mechanism upon impact as well as an acceleration switch. In such a dual use, an impact pin or other device may be positioned in the nose, for example, to crush dome switch member 500 upon impact.

The present invention provides, either separately or in combination, a reliable electro-mechanical method of setback and deceleration detection to closely approximate both an ideal impact detection mechanism and an ideal setback detection mechanism. The deceleration and setback detection mechanisms may incorporate inexpensive stainless steel snap domes as switches as described. Upon setback, for example, caused by acceleration in excess of a selected acceleration threshold, dome switch member 500 in FIG. 5 snaps over to short circuit the pair of contacts provided by one electrical conductor arrangement of electrical surface contact assembly 500. One example of such an electrical conductor arrangement is illustrated in FIGS. 1, 4 and 5 as a conductive layer of a two sided printed wiring board. In operation, impacts, even grazing impacts, with deceleration forces in excess of the detection threshold will cause dome switch member 100, in combination with the mass enhancing weight of mass 40, to snap over.

The sensing switch assembly of the present invention offers other advantages over the prior art due to the bifurcated or scalloped design of the dome switch. Because of the scalloped shape, all of the switch contacts of the electrical contact assembly 200 may be printed on the same surface, thus eliminating the need for troublesome vias (i.e. plated through holes for providing a conductive path from one layer to another in a printed circuit assembly). The sensing switch has operated to provide a sensing signal in about 25 microseconds. This performance represents an improvement in accuracy of an order of magnitude over the prior art.

It should be recognized by those skilled in the art that the acceleration/deceleration sensing switch assemblies described in accordance with the preset invention may be made very small as compared to current techniques. Deformation of the dome switch is only affected by forces generally perpendicular to the central surface thereof which are intended to be aligned perpendicular to the firing axis of the munitions. Therefore the acceleration/deceleration switch assembly in accordance with the present invention are not appreciably affected by spin or non-spin dependencies as may affect other switch techniques commonly know in the munitions art. Furthermore, because of elegant simplicity of design, the acceleration/deceleration sensing switch assembles of the present invention are relatively inexpensive to build, highly reliable, and so versatile so as to be employable over a wide range of combat rounds from very small to very large, from smooth bore to rifled.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

The embodiments of an invention in which an exclusive property or right is claimed are defined as follows:

1. A discriminating acceleration sensing electrical switch assembly enclosed within a munitions projectile for providing an electrical circuit path between a pair of electrical contacts upon acceleration of the projectile being greater than a selected acceleration threshold value along a projectile reference axis that is in general alignment with an intended traveling direction of the projectile, said discriminating acceleration sensing electrical switch assembly comprising:

a switch support means affixed to said munitions projectile;

an electrical contact assembly, affixed to said support means, having a pair of electrically conductive surface regions, where the pair of electrically conductive surface regions are isolated from each other; and a tactile dome switch coupled to said switch support means in proximity to said electrical contact assembly, and arranged along a firing axis of the munitions projectile such that, upon sufficient acceleration along the firing axis, an acceleration force acting on said tactile dome switch causes said tactile dome switch to deform and make contact with said electrically conductive surface regions thereby providing switch closure that electrically shorts together the pair of electrically conductive surface regions.

2. The discriminating acceleration sensing electrical switch assembly of claim 1 wherein said tactile dome switch comprises a scalloped disc having a plurality of protruding terminals held in contact with one of said pair of electrically conductive surface regions.

3. The discriminating acceleration sensing electrical switch assembly of claim 2, wherein said switch support means has a bore hole substantially aligned with said projectile reference axis, and wherein said bore hole comprises a plurality of recesses for receiving and holding said plurality of protruding terminals in place.

4. A discriminating deceleration sensing electrical switch assembly enclosed within a munitions projectile for providing an electrical circuit path between a pair of electrical contacts upon deceleration of the projectile being greater than a selected deceleration threshold value as sensed along a projectile reference axis that is in general alignment with an intended traveling direction of the projectile, said discriminating deceleration sensing electrical switch assembly comprising:

a switch support means having a bore hole therein for containing a mass, said switch support means affixed to said munitions projectile and said bore hole being substantially aligned with said projectile reference axis;

an electrical contact assembly affixed to said support means, and having a pair of electrically conductive surface regions, where the pair of electrically conductive surface regions are isolated from each other; and a tactile dome switch juxtaposed between said mass and said electrical contact assembly and arranged along a firing axis of the munitions projectile such that upon sufficient deceleration along the firing axis, a force acting on said mass causes said tactile dome switch to deform and make contact with said electrically conductive surface regions thereby providing switch closure that electrically shorts together the pair of electrically conductive surface regions.

5. The discriminating deceleration sensing electrical switch assembly of claim 4 wherein said tactile dome switch comprises a scalloped disc having a plurality of protruding terminals held in contact with one of said pair of electrically conductive surface regions.

6. The discriminating deceleration sensing electrical switch assembly of claim 5 wherein said bore hole comprises a plurality of recesses for receiving and holding said plurality of protruding terminals in place.

7. The discriminating deceleration sensing electrical switch assembly of claim 4 wherein said mass comprises a spherical mass.

8. A discriminating deceleration sensing electrical switch assembly enclosed within a munitions projectile for providing an electrical circuit path between a pair of electrical contacts upon deceleration of the munitions projectile being greater than a selected deceleration threshold value along a projectile reference axis, the reference axis being in general alignment with an intended traveling direction of the projectile, said discriminating deceleration sensing electrical switch assembly comprising:

a switch support means including a bore hole of a selected bore hole diameter, the bore hole extending longitudinally from an open end of said switch support means, and having a central bore hole reference axis passing axially therethrough in general alignment with said projectile reference axis;

a spherical ball contained with said bore hole, said spherical ball having a selected ball mass and having a diameter sufficiently smaller than said bore hole diameter so as to permit said spherical ball to travel within said bore hole;

a mechanically resilient and electrically conductive disk member having a concave first surface on a first side, and a convex second surface on a second opposite side, a plurality of protruding terminals and having a central disk axis passing therethrough, said mechanically resilient disk member coupled to said switch support means in proximity to said switch support means open end with said central disk axis substantially aligned with said bore hole reference axis;

an electrical surface contact assembly including a support member for supporting at least a first electrical conductor arrangement for providing said pair of electrical contacts, including, a first electrically conductive surface region having a contact reference axis passing perpendicular through said first electrically conductive surface region, a second electrically conductive surface region displaced from said first electrically conductive surface region and electrically isolated therefrom, wherein said second electrically conductive surface region is in contact with the plurality of protruding terminals; and wherein said electrical surface contact assembly is affixed to said switch support means in proximity to said bore hole open end with said contact reference axis substantially aligned with said bore hole reference axis, and with said first electrically conductive surface region in proximity to and covered by said concave surface of said disk member such that deceleration of said projectile in excess of said selected deceleration threshold causes said spherical ball to act upon said convex second surface of said disk member, causing said disk member to deform such that said concave surface contacts said first electrically conductive surface region to provide an electrically conductive path between said first and second electrically conductive surface regions.

9. A discriminating acceleration/deceleration sensing electrical switch assembly enclosed within a munitions projectile for providing a first electrical circuit path between a first pair of electrical contacts upon acceleration of the projectile being greater than a selected acceleration threshold value along a projectile reference axis in general alignment with an intended traveling direction of the projectile, and providing a second electrical circuit path between a second pair of electrical contacts upon deceleration of the projectile being greater than a selected deceleration threshold value along said projectile reference axis, said discriminating acceleration/deceleration sensing electrical switch assembly comprising:

a switch support means including a bore hole of a selected bore hole diameter, extending longitudinally from an open end of said switch support means, and having a central bore hole reference axis passing axially therethrough and in general alignment with said projectile reference axis;

a spherical ball contained with said bore hole, said spherical ball having a selected ball mass and having a diameter sufficiently smaller than said bore hole diameter so as to permit said spherical ball to travel within said bore hole;

first and second mechanically resilient and electrically conductive disk members each having a concave first surface on a first side, and a convex second surface on a second opposite side, a plurality of protruding terminals and having a central disk axis passing therethrough, said mechanically resilient disk members coupled to said switch support means in proximity to said switch means open end with said central disk axis substantially aligned with said bore hole reference axis;

an electrical surface contact assembly including a support member for supporting first and second electrical conductor arrangements for providing said first and second pair of electrical contacts, respectively, where each of said first and second electrical conductor arrangements includes, a first electrically conductive surface region having a contact reference axis passing perpendicular through said first electrically conductive surface region, a second electrically conductive surface region displaced from said first electrically conductive surface region and electrically isolated therefrom, wherein said second electrically conductive surface region is in contact with the plurality of protruding terminals; and wherein said electrical surface contact assembly is juxtaposed between said concave surfaces of said first and second mechanically resilient and electrically conductive disk members, and is affixed to said switch support means in proximity to said bore hole open end with said contact reference axis of each of said first and second electrical conductor arrangements being substantially aligned with said bore hole reference axis, and wherein said first electrically conductive surface region of each of said first and second electrical conductor arrangements are proximate to and covered by said concave surfaces of said first and second disk members, and wherein said second electrically conductive surface regions are in respective contact with the plurality of terminals of said first and second mechanically resilient and electrically conductive disk members such that, (i) acceleration of said projectile in excess of said selected acceleration threshold causes an acceleration force of said munitions projectile to act upon said convex second surface of said first disk member to cause said first disk member to deform such that said concave surface of said first disk member contacts said first electrically conductive surface region of said first electrical conductor arrangement to provide an electrically conductive path between said first and second electrically conductive surface regions, and (ii) deceleration of said projectile in excess of said selected deceleration threshold causes said spherical ball to act upon said convex second surface of said second disk member, causing said second disk member to deform such that said concave surface of said second disk member contacts said second electrically conductive surface region to provide an electrically conductive path between said first and second electrically conductive surface regions.

10. A discriminating acceleration sensing electrical switch assembly enclosed within a munitions projectile for providing an electrical circuit path between a pair of electrical contacts upon acceleration of the projectile being greater than a selected acceleration threshold value along a projectile reference axis in general alignment with an intended traveling direction of the projectile, said discriminating acceleration electrical switch assembly comprising:

a switch support means;

a mechanically resilient and electrically conductive disk member having a concave first surface on a first side, and a convex second surface on a second opposite side, a plurality of protruding terminals, and having a central disk axis passing therethrough, said mechanically resilient disk member coupled to said switch support means such that said central disk axis is substantially aligned with said projectile reference axis;

an electrical surface contact assembly including a support member for supporting an electrical conductor arrangement for providing a pair of electrical contacts, where said electrical conductor arrangement includes at least, a first electrically conductive surface region having a contact reference axis passing perpendicularly through said first electrically conductive surface region, and a second electrically conductive surface region displaced from said first electrically conductive surface region and electrically isolated therefrom, wherein said second electrically conductive surface region is in contact with the plurality of protruding terminals; and said electrical surface contact assembly being affixed to said switch support means with said contact reference axis substantially aligned with said projectile reference axis, and with said first electrically conductive surface region of said electrical conductor arrangement being in proximity to and covered by said concave surface disk member such that acceleration of said projectile in excess of said selected acceleration threshold value causes an acceleration force of said munitions projectile to act upon said convex second surface of said disk member and causes said disk member to deform such that said concave surface contacts said first electrically conductive surface region of said electrical conductor arrangement to provide an electrically conductive path between said first and second electrically conductive surface regions.

11. A discriminating deceleration sensing electrical switch assembly enclosed within a munitions projectile for providing an electrical circuit path between a pair of electrical contacts upon deceleration of the projectile being greater than a selected deceleration threshold value along a projectile reference axis that is in general alignment with an intended traveling direction of the projectile, said discriminating deceleration sensing electrical switch assembly comprising:

a switch support affixed to said munitions projectile;

an electrical contact assembly, affixed to said switch support, having a pair of electrically conductive surface regions, where the pair of electrically conductive surface regions are isolated from each other; and a tactile dome switch coupled to said switch support in proximity to said electrical contact assembly, and arranged along a firing axis of the munitions projectile such that, upon sufficient deceleration along the firing axis, a deceleration force acting on said tactile dome switch causes said tactile dome switch to deform and make contact with said electrically conductive surface regions thereby providing switch closure that electrically shorts together the pair of electrically conductive surface regions.

12. The discriminating deceleration sensing electrical switch assembly of claim 11 wherein said tactile dome switch comprises a scalloped disc having a plurality of protruding terminals held in contact with one of said pair of electrically conductive surface regions.

13. The discriminating deceleration sensing electrical switch assembly of claim 12, wherein said switch support has a bore hole substantially aligned with said projectile reference axis, and wherein said bore hole comprises a plurality of recesses for receiving and holding said plurality of protruding terminals in place.

* * * * *

UNITED STATES PATENT AND TRADEMARK OFFICE

CERTIFICATE OF CORRECTION

PATENT NO. : 5,914,459
DATED : June 22, 1999
INVENTOR(S) : Teske, et. al.

It is certified that error appears in the above-identified patent and that said Letters Patent is hereby corrected as shown below:

Title page, item [75] "Inventors", line 4, delete the name "Johson" and insert –Johnson–.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*